US009597728B2

(12) United States Patent
Huang et al.

(10) Patent No.: US 9,597,728 B2
(45) Date of Patent: Mar. 21, 2017

(54) SYSTEM AND ARTICLE OF MANUFACTURE FOR DIRECTIONAL CASTING

(71) Applicant: General Electric Company, Schenectady, NY (US)

(72) Inventors: Shyh-Chin Huang, Latham, NY (US); Roger John Petterson, Sun City West, AZ (US)

(73) Assignee: General Electric Company, Niskayuna, NY (US)

( * ) Notice: Subject to any disclaimer, the term of this patent is extended or adjusted under 35 U.S.C. 154(b) by 41 days.

(21) Appl. No.: 14/303,923

(22) Filed: Jun. 13, 2014

(65) Prior Publication Data

US 2014/0290896 A1 Oct. 2, 2014

Related U.S. Application Data

(62) Division of application No. 13/198,506, filed on Aug. 4, 2011, now Pat. No. 8,752,611.

(51) Int. Cl.
*B22D 27/04* (2006.01)
*B22D 46/00* (2006.01)

(52) U.S. Cl.
CPC ..... *B22D 27/045* (2013.01); *B22D 46/00* (2013.01)

(58) Field of Classification Search
CPC ..... B22D 27/04; B22D 27/045; B22D 46/00
USPC .... 164/338.1, 151.4, 157, 122.1, 122.2, 128
See application file for complete search history.

(56) References Cited

U.S. PATENT DOCUMENTS 4,108,236 A 8/1978 Salkeld
6,276,433 B1 8/2001 Gigliotti
6,308,767 B1 * 10/2001 Hugo et al. ..... B22D 27/045 164/122.1
6,311,760 B1 11/2001 Fernihough
6,446,700 B1 9/2002 Klug
(Continued)

FOREIGN PATENT DOCUMENTS

CN 101885037 A 11/2010
EP 1110645 B1 4/2004
(Continued)

OTHER PUBLICATIONS

Dubrovskiy et al., "Experience in Producing Blades by Directed High-speed Crystallization", Litejnoe Proizvodstvo, pp. 17-19, Jan. 1995.

(Continued)

*Primary Examiner* — Kevin P Kerns
(74) *Attorney, Agent, or Firm* — Ann M. Agosti

(57) ABSTRACT

A system and method for directionally casting an elongated device are provided. The method includes orienting a mold within a furnace such that a first portion of the mold points downward. The first portion of the mold defines a space within the mold used to form a first end of the device. The first end of the device, when formed, has a greater mass than a second end of the device. The method also includes filling the mold with molten metal and lowering the mold out of the furnace into a liquid metal bath to immerse the first portion of the mold in the liquid metal bath. The method includes concurrently lowering the mold and the liquid metal bath to cool the molten metal.

10 Claims, 4 Drawing Sheets

(56) References Cited

U.S. PATENT DOCUMENTS

| | | | | |
|---|---|---|---|---|
| 6,622,774 | B2 * | 9/2003 | Song | B22D 27/045 164/128 |
| 6,868,893 | B2 | 3/2005 | Shimohata | |
| 6,966,756 | B2 | 11/2005 | McGrath | |
| 8,171,981 | B2 | 5/2012 | Graham | |
| 8,307,881 | B2 | 11/2012 | Huang et al. | |
| 8,752,611 | B2 * | 6/2014 | Huang et al. | B22D 27/045 164/122.1 |
| 2001/0001415 | A1 | 5/2001 | Gerasimov | |
| 2008/0257517 | A1 | 10/2008 | Elliott | |
| 2009/0126893 | A1 | 5/2009 | Huang | |

FOREIGN PATENT DOCUMENTS

| | | | |
|---|---|---|---|
| EP | 0968065 | B1 | 12/2004 |
| WO | WO99/12679 | A1 | 3/1999 |

OTHER PUBLICATIONS

Betz et al., "Investigating the Liquid Metal Cooling Process", Metallurgia, vol. No. 68, Issue No. 3, Mar. 2001.

Unofficial English translation of Office Action issued in connection with corresponding CN Application No. 201210274671.8 on Dec. 3, 2015.

* cited by examiner

SYSTEM AND ARTICLE OF MANUFACTURE FOR DIRECTIONAL CASTING

This application is a divisional of U.S. application Ser. No. 13/198,506 filed Aug. 4, 2011, which issued as U.S. Pat. No. 8,752,611 on Jun. 17, 2014.

BACKGROUND

In certain manufacturing processes, a device or component of a device may be cast or molded. For example, a molten material, such as a molten metal, may be poured into a mold and cooled to form the device or component in question. In certain casting systems, an elongated columnar structure may be produced that has multiple unidirectional crystals aligned substantially parallel, such as to an axis of the casting. The aligned crystal structure of a device produced from such systems may have crystal grain boundaries where faults or breaks may occur. In other directional casting systems, a single crystal device may be made that contains no grain boundaries, thereby enhancing the strength of the device. Such a single crystal device may be produced using a method of directional solidification for cooling the casting. Using directional solidification, a desired single crystal growth structure is created, typically at the base of a vertically disposed mold defining a device. The crystal growth structure then grows from the base to the top of the mold as molten metal in the mold solidifies.

Liquid metal cooled directional solidification processes may be used with directional solidification systems to create such a single crystal structure. For example, a mold may be filled with a molten metal while the mold is in a furnace. The furnace may include an induction coil or resistance heater to maintain the heat of the furnace. The mold may then be lowered into a liquid metal bath. The molten metal in the mold becomes solidified in the liquid metal bath due to the large thermal gradient between the mold (including the molten metal) and the liquid metal bath. The mold first solidifies into a crystal structure at the base of the mold, and then the crystal grows as more molten metal solidifies. The speed of solidification is controlled by how fast the mold is moved from the furnace into the liquid metal bath. To create the single crystal structure, the mold is lowered into the liquid metal bath at a specific, controlled rate. However, due to the temperature extremes and gradients involved, while in the liquid metal bath, the mold may crack and metal from the liquid metal bath may contact the device being formed, thereby causing imperfections to form on the device (e.g., pits in the metal of the device). Such manufacturing defects may result in a formed product being unusable or unacceptable for its intended purpose.

BRIEF DESCRIPTION

In accordance with one embodiment, a method of directionally casting an elongated device using a mold is provided. The method includes orienting the mold within a furnace such that a first portion of the mold points downward. The first portion of the mold defines a space within the mold used to form a first end of the device. The first end of the device, when formed, has a greater mass than a second end of the device. The method also includes filling the mold with molten metal and lowering the mold out of the furnace into a liquid metal bath to immerse the first portion of the mold in the liquid metal bath. After the first portion of the mold is immersed, the method includes concurrently lowering the mold and the liquid metal bath to cool the molten metal. While the mold and the liquid metal bath are being lowered, the first portion of the mold is maintained within the liquid metal bath and a remaining portion of the mold is outside the liquid metal bath.

In accordance with another embodiment, a system to directionally cast an elongated device is provided. The system includes a mold for the device configured to be filled with molten metal. The mold has a first portion used to form a first end of the device. The first end of the device, when formed, has a greater mass than a second end of the device. The system also includes a furnace having an open bottom end for withdrawing the mold and a liquid metal bath disposed below the furnace and configured to cool molten metal within the mold and to be lowered while the mold is being lowered. The system includes a controller configured to cause the mold to be filled with molten metal. The controller is also configured to cause the mold to be lowered out of the furnace into the liquid metal bath to immerse the first portion of the mold in the liquid metal bath, and then to cause the mold and the liquid metal bath to be concurrently lowered to cool the molten metal. While the mold and the liquid metal bath are being lowered, the controller is configured to cause the first portion of the mold to be maintained within the liquid metal bath and to cause a remaining portion of the mold to be outside the liquid metal bath.

In accordance with a further embodiment, an article of manufacture is provided. The article of manufacture includes one or more tangible, machine-readable media having instructions encoded thereon for execution by a processor. The machine-readable media includes instructions to fill a mold with molten metal and instructions to lower the mold out of the furnace into a liquid metal bath to immerse a first portion of the mold in the liquid metal bath. The first portion of the mold defines a space within the mold used to form a first end of the device. The first end of the device, when formed, has a greater mass than a second end of the device. The machine-readable media also includes instructions to concurrently lower the mold and the liquid metal bath after the first portion of the mold is immersed. While the mold and the liquid metal bath are being lowered, the machine-readable media includes instructions to maintain the first portion of the mold within the liquid metal bath and to keep a remaining portion of the mold outside the liquid metal bath.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
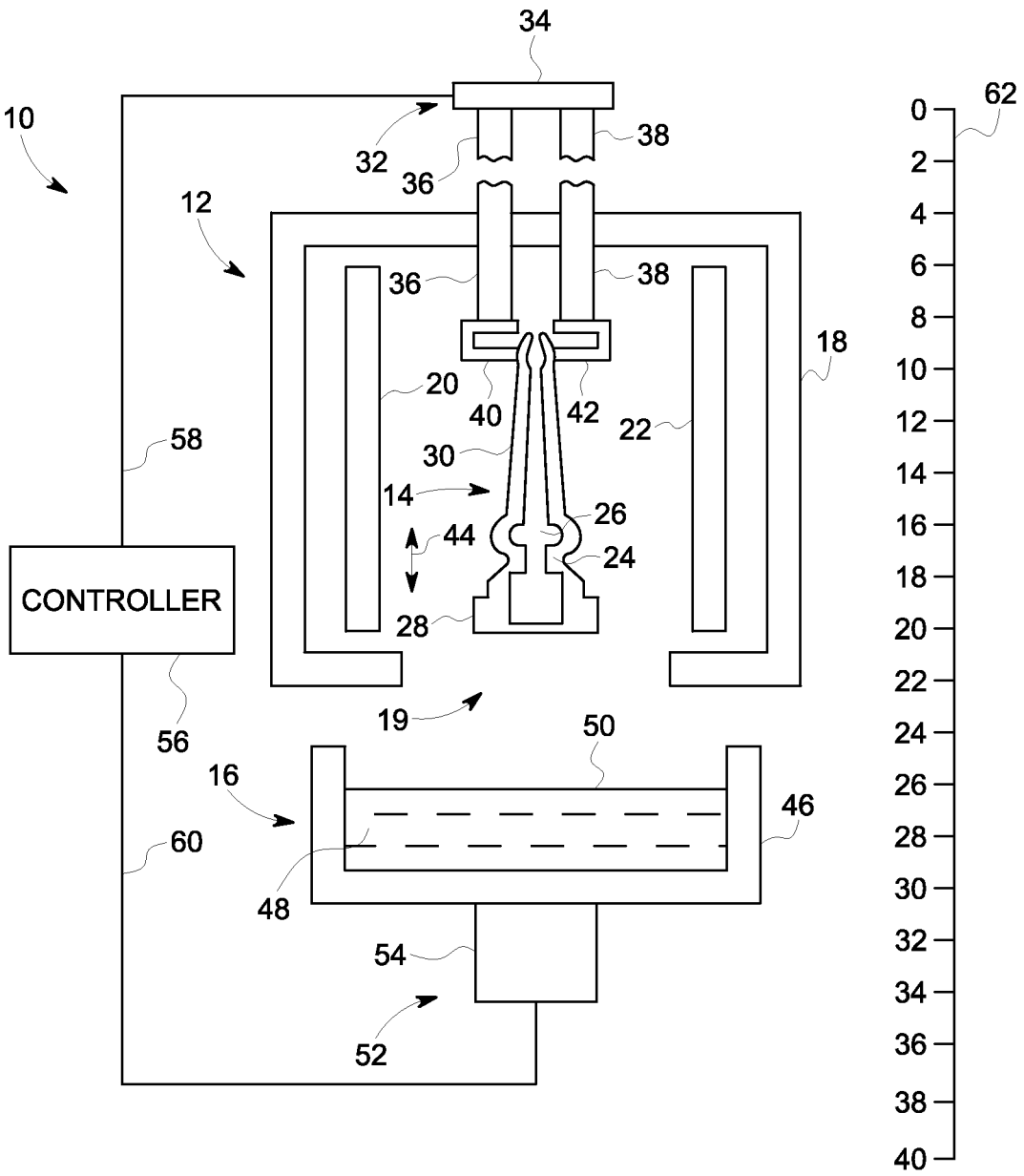
FIG. 1 is a schematic of an embodiment of a system for directionally casting an elongated device.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed herein, a system and method for directionally casting an elongated device may be used to produce a device, such as a gas turbine bucket (i.e., turbine blade). A gas turbine bucket includes an airfoil section. On one end of the airfoil section there may be a "shroud" to inhibit gases from bypassing the bucket without providing energy to that stage of the turbine engine. On the opposite end of the airfoil section there is a platform and shank region. The platform seals a hot gas region of the gas turbine from a turbine wheel that the turbine bucket is attached to and the shank is a lower extension of the bucket. On the opposite side of the bucket is a fir-tree or dovetail region that attaches to the turbine wheel. As may be appreciated, the lower section of the turbine blade (e.g., the platform, shank, and dovetail/fir-tree) has a larger cross section and mass than the upper section of the turbine blade (e.g., airfoil). It should be noted that the liquid metal cooling directional solidification process may be most beneficial in objects where heat removal is more difficult, such as the lower section of the turbine blade. As such, the upper section of the turbine blade may have limited benefits from liquid metal cooling. Therefore, because certain surface defects occur when a casting surface contacts liquid metal, the system and method presented herein limit parts of the mold that contact the liquid metal bath.

In one implementation, the approach involves positioning a mold used to produce the device so that the portion of the mold used to form the end of the device with the greatest mass is pointing downward with respect to the furnace and/or the cooling bath in which the mold will be partially submerged. Molten metal is used to fill the mold and the mold is cooled by moving the mold into a cooling area. In one embodiment, the cooling area includes a liquid metal bath or other cooling bath. In one implementation, only a portion of the mold, e.g., the downward portion of the mold, is lowered into the liquid metal bath. The mold and the liquid metal bath are then both concurrently lowered to cool the molten metal. Such a method and system may decrease the occurrence of cracks occurring in the mold and therefore improve the quality of the directionally casted device.

With the foregoing comments in mind and turning to FIG. 1, this figure illustrates schematically a system 10 for directionally casting an elongated device. In the illustrated embodiment, the system 10 includes a furnace 12, a mold 14, and a liquid metal bath 16. The furnace 12 is used to heat the mold 14 and to maintain a controlled temperature of molten metal after it is poured into the mold 14. As illustrated, the furnace 12 includes an insulated box 18 with an opening 19 at the bottom end of the furnace 12. The insulated box 18 keeps heat within the furnace 12 and the opening 19 allows the mold 14 to be moved out of the furnace 12. The furnace 12 is heated using heating strips 20 and 22, such as resistance heated graphite strips. In certain embodiments, the furnace 12 may be heated by other devices.

The mold 14 includes a mold shell 24, a mold interior 26, a first portion 28, and a remaining portion 30. The mold shell 24 defines the shape of the mold 14 and is used to produce the elongated device. The elongated device is formed by filling the mold shell 24 with molten metal. The molten metal fills the mold interior 26 and is cooled to form the elongated device. In one embodiment, the cooling process is controlled so that the elongated device has a single crystal structure. The molten metal may be a nickel alloy, cobalt alloy, iron-based alloy, or another metal or alloy. In certain embodiments, the molten metal may be heat resistant with an increased strength and oxidation resistance at high temperatures. Furthermore, the molten metal may include chromium, molybdenum, tungsten, columbium, titanium, or aluminum as constituents. For example, the molten metal may include chromium to improve the surface stability of the device. As another example, the molten metal may include molybdenum, tungsten, columbium, titanium, or aluminum to provide greater strength to the device.

The first portion 28 of the mold 14 points downward toward the opening 19 in the furnace 12. Furthermore, the first portion 28 of the mold 14 defines a region or portion of the mold 14 in which a first end of the device is formed that has a greater mass than that portion of the device formed at the opposing end of the mold 14. Thus, the remaining portion 30 of the mold 14 includes a part of the mold 14 that is not part of the first portion 28 and which defines the part of the mold 14 that is used to form a second end of the device that has a lower mass than the first end of the device, when formed. For example, the first portion 28 of the mold 14 may be used to form the shank section of a turbine bucket while the remaining portion 30 of the mold 14 may be used to form the airfoil section of the turbine bucket.

A mold positioning assembly 32 may be used to lower or raise the mold 14. For example, the mold positioning assembly 32 may lower the mold 14 into the liquid metal bath 16 or raise the mold 14 out of the liquid metal bath 16. The mold positioning assembly 32 includes an actuation system 34, arms 36 and 38, and fingers 40 and 42. The actuation system 34 is configured to raise and lower the arms 36 and 38. Further, the actuation system 34 may use any type of actuator to move the arms 36 and 38. For example, the actuation system 34 may include a hydraulic, pneumatic, or electric actuator to move the arms 36 and 38. The arms 36 and 38 extend from the actuation system 34 into the furnace 12. As may be appreciated, the arms 36 and 38 extend or retract from the actuation system 34 to move the mold 14. Fingers 40 and 42 are attached to the arms 36 and 38, respectively, and secure the mold 14 during the directional casting process.

As illustrated, the mold positioning assembly 32 may move the mold 14 in the directions illustrated by arrow 44. For example, the mold positioning system 32 may move the mold 14 through the opening 19 of the furnace 12. Although not illustrated, the system 10 for directionally casting an elongated device may include a filling system for filling the mold 14 with molten metal. Such a filling system is commonly known in the art.

A liquid metal bath 16 is positioned beneath the opening 19 of the furnace 12 so that the mold 14 may be lowered into the liquid metal bath 16. The liquid metal bath 16 includes a bath container 46 filled with liquid metal 48. The bath container 46 keeps the liquid metal 48 contained and includes capacity to allow a liquid level 50 to adjust as the mold 14 is lowered into the liquid metal 48. As may be appreciated, the bath container 46 may be made of metal or some other material. The liquid metal 48 may include such metals as lithium, sodium, magnesium, aluminum, potassium, zinc, gallium, selenium, rubidium, cadmium, indium, tin, antimony, tellurium, cesium, mercury, thallium, lead, or bismuth. In certain embodiments, the liquid metal 48 may be solely aluminum or tin. In other embodiments, the liquid metal 48 may be an aluminum or tin alloy.

When the mold 14 is lowered into the liquid metal bath 16, the bath 16 removes heat from the mold 14 and the solidification process progresses from the bottom (i.e., the first portion 28) of the mold 14, to the top (i.e., the remaining portion 30) of the mold 14. The liquid metal bath 16 is mounted to a bath positioning system 52 which includes a base 54. The base 54 is configured to move the liquid metal bath 16 up and down in the vertical direction.

A controller 56 is communicatively coupled to the mold and bath positioning systems 32 and 52 via respective cables 58 and 60 in one embodiment. The controller 56 is configured to control the operation of the mold positioning system 32 and the bath positioning system 52. Furthermore, the controller 56 may be configured to control a filling system to fill the mold 14 with molten metal. For example, the controller 56 may be configured to cause the filling system to fill the mold 14, to cause the mold positioning system 32 to lower the mold 14 to immerse the first portion 28 of the mold in the liquid metal bath 16, and to cause the mold positioning system 32 and the bath positioning system 52 to concurrently lower the mold 14 and the liquid metal bath 16 to cool the molten metal. In addition, the controller 56 may be configured to cause the first portion 28 of the mold 14 to be maintained within the liquid metal bath 16 and to cause the remaining portion 30 of the mold 14 to be outside the liquid metal bath 16. Further, the mold positioning system 32 and the bath positioning system 52 are configured to receive control signals from the controller 56 to control their movement.

The controller 56 may include a memory, a processor, and a nonvolatile storage. Further, the memory may include a volatile memory, such as random access memory (RAM), and/or a nonvolatile memory, such as read-only memory (ROM). The memory may store processor-executable instructions (e.g., firmware or software) for the controller 56 to carry out the techniques disclosed herein. The processor may execute the instructions to control the controller 56. The processor may include one or more microprocessors, such as one or more "general-purpose" microprocessors, one or more special-purpose microprocessors and/or ASICS, or some combination thereof. For example, the processor may include one or more reduced instruction set (RISC) processors. The nonvolatile storage of the controller 56 of the presently illustrated embodiment may include ROM, flash memory, a hard drive, or any other suitable optical, magnetic, or solid-state non-transitory storage medium, or a combination thereof. The storage may store data files (e.g., timing schedules), instructions (e.g., software or firmware to implement functions of the controller 56), and any other suitable data. For example, the memory or nonvolatile storage may store executable instructions to fill the mold 14, executable instructions to move the mold 14, and executable instructions to move the liquid metal bath 16. Such instructions may include instructions to control the timing of the filling, movement of the mold 14, and movement of the liquid metal bath 16 according to a predetermined schedule, such as a timing schedule stored in the nonvolatile storage.

Figure 2:
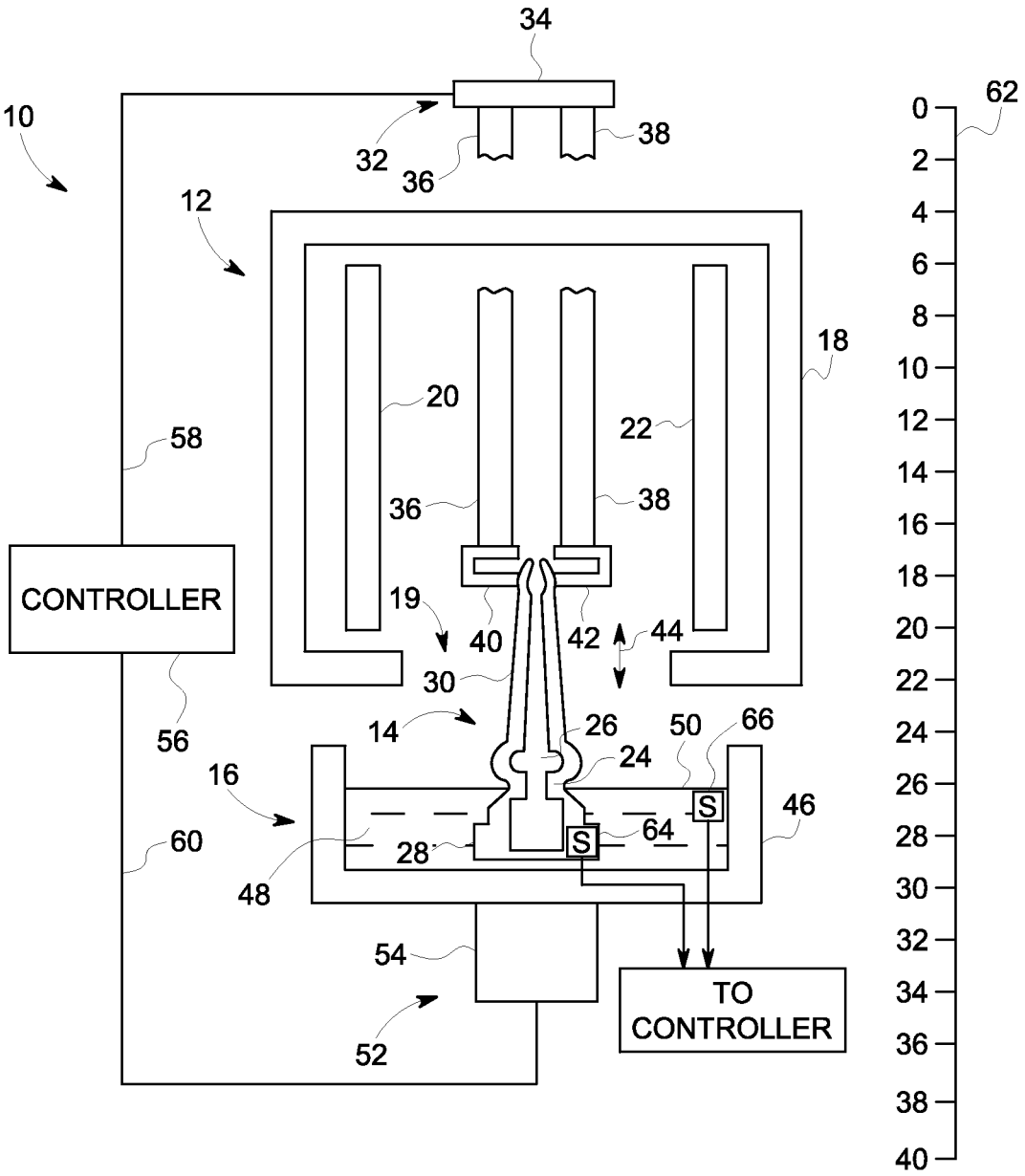
FIG. 2 is a schematic of an embodiment of the system of FIG. 1, illustrating the mold lowered into the liquid metal bath.
Figure 3:
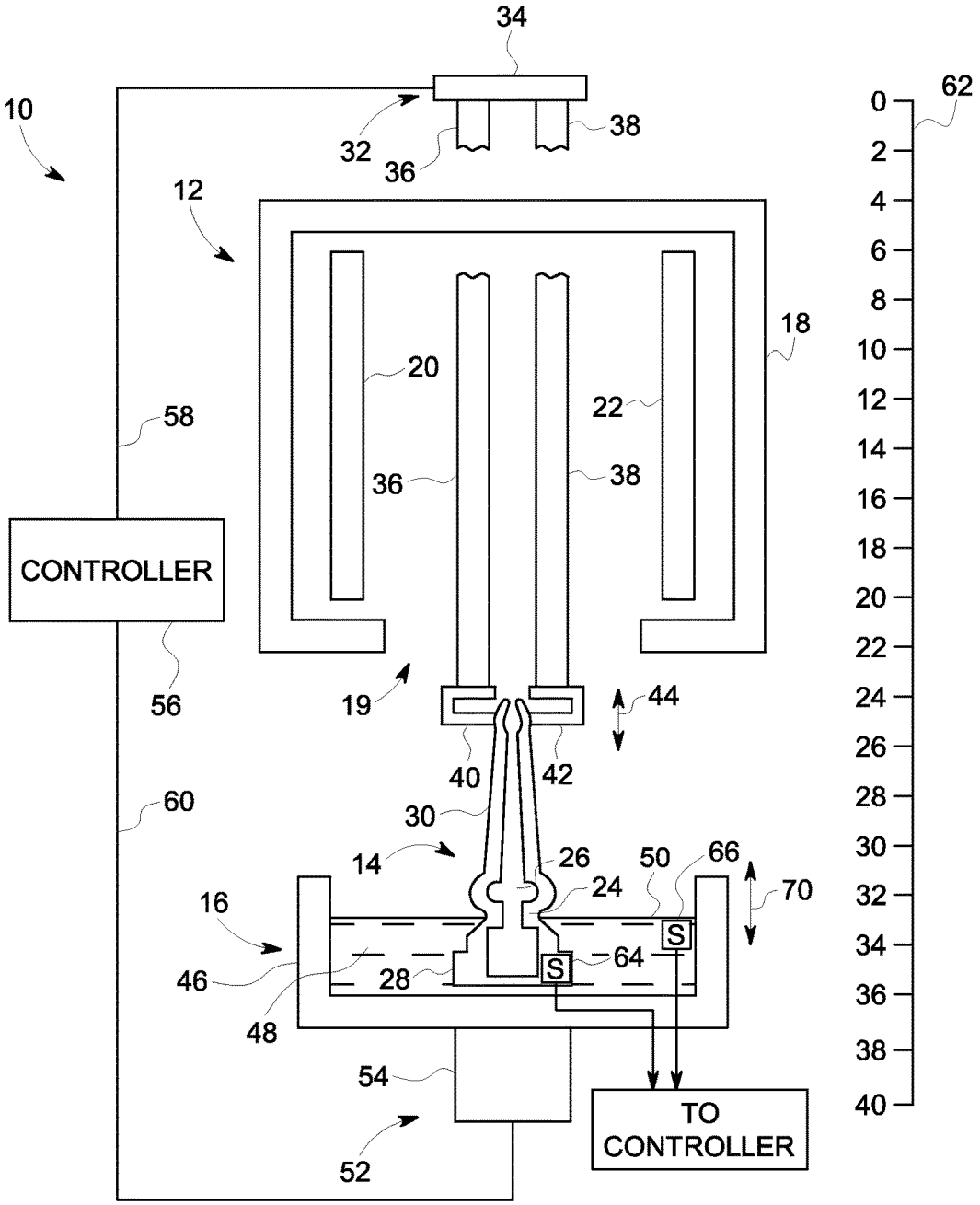
FIG. 3 is a schematic of an embodiment of the system of FIG. 2, illustrating the mold and the liquid metal bath being concurrently lowered.

A unitless ruler 62 is illustrated in FIGS. 1 through 3 to show relative locations of the furnace 12, the mold 14, and the liquid metal bath 16 as the mold 14 proceeds through the directional solidification process. For example, in FIG. 1, the furnace 12 is positioned between approximately location 4 on the ruler 62 and approximately location 22 on the ruler 62, while the mold 14 is positioned between approximately location 8 on the ruler 62 and approximately location 20 on the ruler 62. Further, the liquid metal bath 16 is positioned between approximately location 24 on the ruler 62 and approximately location 30 on the ruler 62.

During operation, the mold 14 is filled with molten metal while the mold 14 positioned within the furnace 12, as illustrated in FIG. 1. The mold 14 is then lowered into the liquid metal bath 16, as illustrated in FIG. 2. The furnace 12 and the liquid metal bath 16 in FIG. 2 remain in the same location shown in FIG. 1. However, the mold positioning system 32 moves the arms 36 and 38 to lower the mold 14 into the liquid metal bath 16. The mold 14 is lowered through the opening 19 in the furnace 12 so that the first portion 28 is immersed in the liquid metal 48 while the remaining portion 30 remains outside of the liquid metal 48. As such, the liquid metal bath 16 causes the molten metal within the first portion 28 to begin to cool and solidify, thus forming a single crystal structure that grows as more of the molten metal solidifies. Further, as the molten metal within the first portion 28 cools and solidifies, the molten metal in the remaining portion 30 cools by conduction with the first portion 28 and the metal in the first portion 28 and the molten metal in the remaining portion 30 cools by radiation through the mold 14 from air outside the mold 14. Essentially, the first portion 28 of the mold 14 acts as a heat sink to the remaining portion 30 of the mold 14.

As illustrated, the mold 14 may be lowered so as to be positioned between approximately location 17 on the ruler 62 and approximately location 28 on the ruler 62. As the mold 14 is lowered into the liquid metal bath 16, the liquid level 50 moves closer to the top of the bath container 46. For example, the liquid level 50 may be at approximately location 26 on the ruler 62 in FIG. 1, while the liquid level 50 may be at approximately location 25 on the ruler 62 in FIG. 2. Although the mold 14 illustrated in FIG. 2 is concurrently within the furnace 12 and the liquid metal bath 16, in certain embodiments, the liquid metal bath 16 may be positioned so the mold 14 exits the furnace 12 completely before entering the liquid metal bath 16. Further, in some embodiments, the liquid metal bath 16 may be positioned so that it does not move concurrently with the lowering of the mold 14. However, to achieve a sharp thermal gradient, the liquid metal bath 16 should be positioned close to the furnace 12 and moved concurrently with the mold 14.

The controller 56 controls the rate that the mold 14 is lowered into the liquid metal bath 16. As may be appreciated, the controller 56 may lower the mold 14 based on a timing schedule (e.g., the controller 56 may process a timing schedule using executable instructions and control the lowering of the mold 14 based on the processed timing schedule). For example, in certain embodiments, the mold 14 may be lowered into the liquid metal bath 16 at approximately 0.5 cm/minute. In other embodiments, the system 10 may include temperature sensors 64 and 66 that provide temperature measurements to the controller 56. The controller 56 may use the temperature of the mold 14 measured from temperature sensor 64 and/or the temperature of the liquid metal bath 16 measured from temperature sensor 66 to control the rate that the mold 14 is lowered into the liquid metal bath 16 (e.g., the controller 56 may include executable instructions to monitor the temperature sensors 64 and 66 and move the mold 14 based on the monitored temperatures).

In the depicted implementation, after the first portion 28 of the mold 14 is immersed in the liquid metal 48, the mold 14 and the liquid metal bath 16 are lowered concurrently to move the mold 14 completely out of the furnace 12. FIG. 3 illustrates the mold 14 moved in the downward direction as shown by arrow 44 and the liquid metal bath 16 concurrently being moved in the downward direction as shown by arrow 70. The mold 14 and the liquid metal bath 16 are moved concurrently to maintain the first portion 28 of the mold 14 immersed in the liquid metal 48 while keeping the remaining portion 30 out of the liquid metal 48. The mold 14 and the liquid metal bath 16 are lowered to move the mold 14 completely out of the furnace 12 so the molten metal will solidify to form the device.

The controller 56 controls the rate that the mold 14 and the liquid metal bath 16 are concurrently lowered once the first portion 28 of the mold 14 immersed in the liquid metal 48. As may be appreciated, the controller 56 may concurrently lower the mold 14 and the liquid metal bath 16 based on a timing schedule (e.g., the controller 56 may process a timing schedule using executable instructions and control the lowering of the mold 14 and the liquid metal bath 16 based on the processed timing schedule). For example, in certain embodiments, the mold 14 and the liquid metal bath 16 may be concurrently lowered at approximately 0.5 cm/minute. In other embodiments, the system 10 may use the temperature of the mold 14 measured from temperature sensor 64 and/or the temperature of the liquid metal bath 16 measured from temperature sensor 66 to control the rate that the mold 14 and the liquid metal bath 16 are concurrently lowered (e.g., the controller 56 may include executable instructions to monitor the temperature sensors 64 and 66 and move the mold 14 and the liquid metal bath 16 concurrently based on the monitored temperatures). As may be appreciated, a device with a single crystal structure may be formed using such a method. Furthermore, by only immersing the first portion 28 of the mold 14 in the liquid metal bath 16, the likelihood of breaks in the mold 14 decreases.

Figure 4:
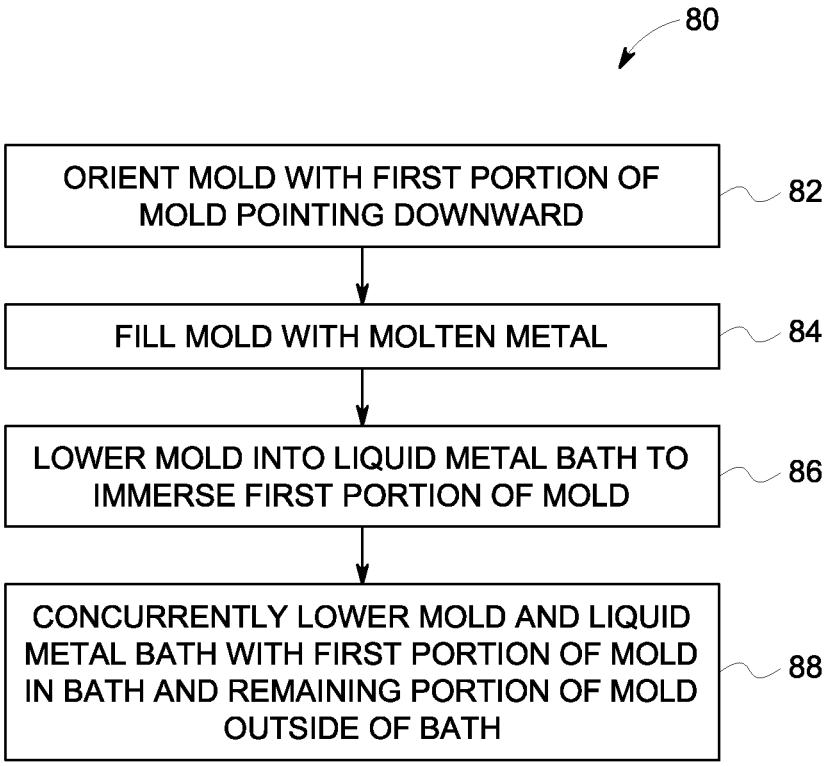
FIG. 4 depicts a flow diagram of one example of a method for directionally casting an elongated device.

FIG. 4 is a method 80 for directionally casting an elongated device and summarizes the illustrations of FIGS. 1 through 3. At step 82, the mold 14 is oriented with the first portion 28 of the mold 14 pointing in a downward direction (e.g., illustrated in FIG. 1). The first portion 28 is pointing downward so that the first portion 28 will be the part of the mold 14 that is immersed in the liquid metal bath 16. Furthermore, when the device is being formed, a first end of the device is the end with the greatest mass and will be formed in the first portion 28. A second end of the device to be formed is the end with lower mass than the first end and will be formed in the remaining portion 30. For example, if the mold 14 is a turbine bucket (i.e., turbine blade) mold, the first portion 28 may be the shank portion of the mold and the remaining portion 30 may be the airfoil portion of the mold. Next, at step 84, the mold 14 is filled with molten metal while the mold 14 is positioned within the furnace 12. Then, at step 86, the mold 14 is lowered into the liquid metal bath 16 to immerse the first portion 28 of the mold 14 (e.g., illustrated in FIG. 2). When the mold 14 leaves the furnace 12 the directional solidification process begins. The large temperature gradient caused by the mold 14 being lowered into the liquid metal bath 16 initiates the crystal structure forming and growing inside the mold 14, thereby beginning solidification of the molten metal. At step 88, the mold 14 is lowered concurrently with the liquid metal bath 16. While the mold 14 and the liquid metal bath 16 are being lowered, the first portion 28 of the mold 14 is kept immersed in the liquid metal 48, while the remaining portion 30 of the mold 14 is kept out of the liquid metal 48. Thus, the solidification process continues until the device is formed (e.g., a single crystal structure device is formed).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system to directionally cast an elongated device, the system comprising:

a mold positioning assembly that comprises a mold for the device wherein the mold is configured to be filled with molten metal and is positioned in a furnace wherein the mold comprises a first portion used to form a first end of the device having a greater mass than a second end of the device;

the furnace having an open bottom end for withdrawing the mold;

a container having a liquid metal bath therein disposed below the furnace wherein the container is vertically movable by a liquid bath positioning system communicatively coupled to a controller and configured to receive signals from the controller to move the liquid metal bath, wherein the liquid bath positioning system and the mold positioning assembly are individually controlled by the controller;

wherein the controller is comprised of a processor, a memory and a nonvolatile storage wherein instructions executable by the processor are stored on the memory and/or the nonvolatile storage, wherein the instructions comprise 1) instructions to cause the mold to be filled with a depth of molten metal, 2) instructions to cause the mold and molten metal to be lowered out of the furnace into the liquid metal bath to immerse the first portion of the mold in the liquid metal bath while maintaining the second portion of the mold outside the liquid metal bath, and 3) instructions to cause the mold and the liquid metal bath to be concurrently lowered away from the furnace to cool the molten metal while maintaining the first portion of the mold within the liquid metal bath and the second portion outside the liquid metal bath throughout the concurrent lowering of the mold and the liquid metal bath so that the molten metal in the second portion cools by radiation through the mold and wherein the depth of liquid metal in the container is less than at least one dimension of the mold.

2. The system of claim 1 wherein the mold positioning system is communicatively coupled to the controller and configured to receive control signals from the controller to move the mold.

3. The system of claim 1, comprising a temperature sensor configured to monitor at least one of a first temperature of the mold and a second temperature of the liquid metal bath.

4. The system of claim 1, wherein the liquid metal bath comprises one or more of lithium, sodium, magnesium, aluminum, potassium, zinc, gallium, selenium, rubidium, cadmium, indium, tin, antimony, tellurium, cesium, mercury, thallium, lead, or bismuth.

5. The system of claim 1, wherein the liquid metal bath comprises an aluminum alloy or a tin alloy.

6. The system of claim 1, wherein the instructions further comprise instructions to cause the mold and the liquid metal bath to be lowered based on a timing schedule.

7. The system according to claim 1, wherein the instructions further comprise instructions to process a timing schedule to determine when to lower the mold and the liquid metal bath.

8. The system according to claim 1, wherein the instructions further comprise instructions to monitor a first temperature of the mold and a second temperature of the liquid metal bath.

9. The system according to claim 8, wherein the instructions further comprise instructions to move the mold and the liquid metal bath based on the monitored first and second temperatures.

10. The system according to claim 1, wherein the second portion cools by radiation through the mold from air outside the mold.

* * * * *